US005159328A

United States Patent [19]

Albrecht

[11] Patent Number: 5,159,328

[45] Date of Patent: Oct. 27, 1992

[54] POINT-OF PURCHASE ILLUMINATING DISPLAY

[75] Inventor: Douglas A. Albrecht, St. Louis, Mo.

[73] Assignee: McKnight Road Enterprises, Inc., Maryland Heights, Mo.

[21] Appl. No.: 379,348

[22] Filed: Jul. 13, 1989

[51] Int. Cl.[5] ..... G08B 5/36

[52] U.S. Cl. ..... 340/815.03; 340/815.12

[58] Field of Search ..... 340/815.01, 815.03, 340/815.12, 815.19, 815.21, 815.23, 815.24, 815.26, 815.30, 815.31, 309.4, 309.5, 478, 479, 908.1, 926, 907, 929, 928; 40/427, 430, 442, 446, 550, 577, 581; 273/1 ES; 362/227, 240, 800, 812

[56] References Cited

U.S. PATENT DOCUMENTS

| | | | |
|---|---|---|---|
| 1,699,030 | 1/1929 | Seelen . | |
| 3,154,871 | 11/1964 | Saila | 40/139 |
| 4,001,810 | 1/1977 | Olsen | 340/338 |
| 4,087,785 | 5/1978 | Dodich | 340/114 |
| 4,271,408 | 6/1981 | Teshima et al. | 362/240 |
| 4,654,629 | 3/1987 | Bezos et al. | 362/800 |
| 4,667,427 | 5/1987 | Been | 40/442 |
| 4,801,928 | 1/1989 | Minter | 340/309.4 |
| 4,929,936 | 5/1990 | Friedman et al. | 340/815.1 |

*Primary Examiner*—Ulysses Weldon
*Assistant Examiner*—M. Fatahiyar
*Attorney, Agent, or Firm*—Rogers, Howell & Haferkamp

[57] ABSTRACT

A point-of-purchase illuminating display comprises a vertical display panel having three sets of lights mounted to its front surface. A first set of lights is spacially arranged around a left side of the display panel perimeter. A second set of lights is spacially arranged around a right side of the display panel perimeter. The third set of lights is arranged in the shape of an arrow pointing upward and is positioned on an upper portion of the display panel between the first and second sets of lights. A digital control circuit controls sequential illumination of the first and second sets of lights beginning from the bottom middle of the display panel and sequencing around the left and right sides of the panel to the top mmiddle portion of the panel. Following the sequential illumination of the first and second sets of lights, the third set of lights is simultaneously illuminated twice by the digital circuit control. The control circuit then resets to or repeat the cycle.

15 Claims, 1 Drawing Sheet

4049
CD4017
4081
CLK
VDD
a b c d e f g h i j
R
CE

POINT-OF PURCHASE ILLUMINATING DISPLAY

BACKGROUND OF THE INVENTION

1. Field of the Invention

This invention relates to a point-of-purchase display sign adapted to attract the attention of consumers, in particular, an illuminated display having controlled sequential flashing lights arranged around its border, and lights at the center of the display arranged in the shape of an arrow that are controlled to illuminate simultaneously.

2. Description of the Related Art

Point-of-purchase display signs of the type provided by the present invention commonly comprise a display board with a plurality of lights mounted on the board, and a control mechanism that controls the illumination of the lights.

It is common for the control mechanism of prior art display signs to control the simultaneous flashing of the lights arranged on the sign. Alternatively, prior art control mechanisms are known that control the flashing of one or more of the lights arranged on the sign at any one instance. Control mechanisms are also known that control the sequential flashing of the lights on the sign to give the illusion of movement of the lights around the display sign.

It is an object of the present invention to combine known features of prior art illuminating display signs in a unique and unobvious manner to produce a unique point-of-purchase display sign that attracts the consumer's attention to the sign, and then directs the consumer's attention to a particular product being promoted by the sign. It is a further object of the present invention to control the illumination of the lights of the sign in a unique pattern and sequence.

SUMMARY OF THE INVENTION

The point-of-purchase illuminating display of the present invention comprises a vertical display panel mounting a plurality of lights arranged in first, second and third sets. The first set comprises lights spacially arranged around the left side of the display panel perimeter. The second set comprises lights spacially arranged around the right side of the display panel perimeter. The third set comprises lights that are arranged in the shape of an arrow at the top of the display panel between the first and second sets of lights. The first, second and third sets of lights completely surround a center area of the display panel.

Releasable fasteners are provided on the center area of the display panel and are adapted to releasably secure a placard to the center area of the panel. The placard is adapted to have the name of the product being promoted by the sign displayed thereon.

The control assembly that controls the illumination of the display lights comprises a digital circuit including AND gates, decade counters, and buffers. The circuit is responsive to clock pulse signals and controls sequential illumination of the lights of the first and second sets, one light at a time. The sequence begins with lights a the bottom middle of the display panel and continues with lights around the opposite sides of the panel to the top middle of the panel. The circuit then controls simultaneous illumination of the arrow-shaped third set of lights following the sequential illumination of the first and second sets of lights.

The control assembly and the first, second and third sets of lights are all powered by one or more batteries. The control assembly and the batteries powering the assembly are all incorporated into the structure of the display sign providing a readily transportable illuminating display.

BRIEF DESCRIPTION OF THE DRAWINGS

Further objects and features of the present invention are revealed in the following detailed description of the preferred embodiment of the invention and in the drawing figures wherein.

DESCRIPTION OF THE PREFERRED EMBODIMENT

Figures 1, 2:
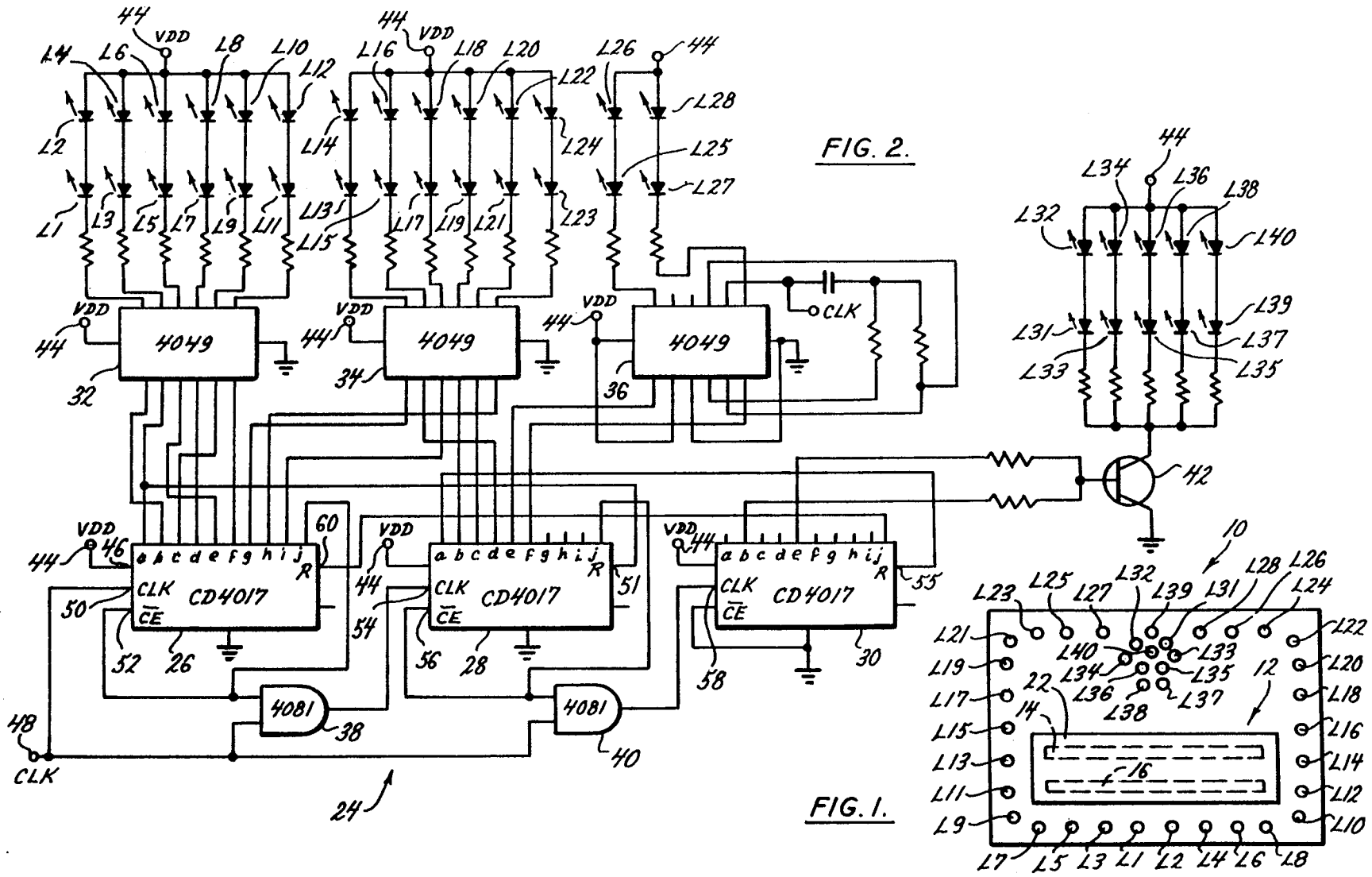
FIG. 1 is a front elevation view of the illuminating display sign of the present invention.
FIG. 2 shows a circuit diagram of the control assembly of the illuminating display of the present invention.

FIG. 1 shows a view of the front surface of the vertical display panel 10 of the present invention. A plurality of lights arranged in three sets are mounted on the front surface of the panel. The first set is comprised of the odd-numbered lights L1–L27 arranged around the left half of the panel 10 periphery as shown in FIG. 1. The second set is comprised of the even-numbered lights L2–L28 arranged around the right side of the panel 10 periphery as seen in FIG. 1. The third set is comprised of the lights numbered L31–L40 arranged in the shape of an arrow at the top middle area of the display panel 10. A center area 12 of the display panel 10 is left open and is surrounded by the lights of the first, second and third sets.

A pair of releasable fasteners 14, 16 are provided on the center area of the panel. A second pair of releasable fasteners (not shown) are secured to the back side of a placard 22. The fasteners are adapted to be secured together to releasably secure the placard to the front surface of the display panel. The placard 22 is adapted to be painted or marked in any known fashion to display the name of the product being promoted by the display 10.

A digital circuit 24 for controlling the ordered illumination of the lights of the first, second and third sets is shown in FIG. 2. The circuit is of a design and construction commonly known in the art and well within the ordinary skill of those who design and construct control circuits of this type. The control circuit 24 comprises a plurality of light-emitting diodes (LEDs) that comprise the three sets of lights mounted on the front surface of the display panel 10. The (LEDs) are interconnected with and have their illumination controlled by a series of semi-conductor chips and AND gates.

More specifically, the digital circuit 24 comprises three semi-conductor chips 26, 28, 30, that function as decade counters. In the preferred embodiment, CD4017 decade counters are used, but any semi-conductor that is a functional equivalent may be employed. The circuit also comprises three 4049 semi-conductors 32, 34, 36, that function as buffers between the LEDs of the first and second sets from the first and second counters 26, 28. The 4049 chip is preferred, but any functional equivalent of this buffer may be employed. A semi-conductor chip comprising two 4081 AND gates 38, 40 controls the sequential enabling of the three counters 26, 28, 30. The third counter 30 is operatively connected through a transistor 42 with the LEDs of the third set and controls their illumination.

The operation of the digital control circuit 24 will be apparent to those skilled in the art. Operation of the first decade counter 26 is initiated on receipt of a DC voltage from a DC power source 44 input to the power input pin 46 of the decade counter, and on receipt of a clock pulse signal produced in any conventional manner at clock connection 48 and received at the decade counter clock input pin 50. On receipt of the clock pulse the sequential counting of the decade counter 26 begins, and a series of signals are sequentially output by the counter through the first six output pins a–f. Each of the signals sequentially output through the pins a–f passes through the buffer 32 and momentarily illuminates in sequence the LEDs L1 and L2, then L3 and L4, and so on until the LEDs L11 and L12 are momentarily lit. The output from the first pin a of the decade counter is also supplied to a reset pin 51 of the second decade counter 28 to reset that counter.

The first decade counter 26 continues to supply output signals through its four remaining output pins g–j. These signals are supplied through the second buffer 34 and momentarily illuminate the LEDs L13 and L14, then L15 and L16, and then L17 and L18. The signal output from the last output pin j of the first decade counter 26 is supplied to an input of the AND gate 38 and the chip enable input 52 of the first decade counter 26. The signal supplied to the chip enable input 52 disables the first decade counter 26. The signal supplied to the AND gate 38 from the first counter, along with a subsequent clock pulse signal supplied to the AND gate from the clock connection 48, causes the gate 38 to emit a signal that is transmitted to the clock input pin 54 of the second decade counter 28. The AND gate signal input to the second decade counter 28 enables the second counter and initiates the output of sequential signals from the output pins a–j of the second counter.

The output from the first pin a of the second counter 28 is supplied to a reset pin 55 of the third decade counter 30 to reset that counter. The outputs from the second, third and fourth pins b–d are supplied through the second buffer 34 to control the momentary illumination of the LEDs L19 and L20, then L21 and L22, and then L23 and L24. The sequence of output signals from the output pins e,f of the second decade counter are supplied through the third buffer 36 to momentarily illuminate the LEDs L25 and L26, and then LEDs L27 and L28. The momentary illumination of the LED L28 completes the controlled sequential illumination of the lights of the first and second sets of lights around the left and right peripheral edges of the display panel 10, respectively.

The signal output from the last pin j of the second decade counter 28 is supplied to an input of the second AND gate 40 and the chip enable input 56 of the second decade counter. The signal supplied to the chip enable input 56 disables the second decade counter 28. The signal supplied to the second AND gate 40 from the second counter, together with a subsequent clock pulse signal supplied to the AND gate 40 from the clock connection 48, causes the second AND gate 40 to emit a signal that is received by the clock input pin 58 of the third decade counter 30. Receipt of the second AND gate signal by the third counter input pin 58 enables the third decade counter 30 and initiates the sequential output of signals from the output pins a–j of the third counter.

As seen in FIG. 2, only the output pins b, e, and j of the third decade counter are connected with other parts of the circuit. The signal supplied from the pin b is supplied to the transistor 42, momentarily turning the transistor on and causing it to conduct. This change of state of the transistor 42 results in the simultaneous illumination of the third set of LEDs L31–L40 and the simultaneous illumination of the arrow shape on the front surface of the display panel 10. When the sequence of output signals supplied from the third decade counter 30 reaches the pin e, the transistor 42 is again momentarily turned on causing it to conduct and again the LEDs L31–L40 of the third set are momentarily illuminated. When the sequence of signals emitted from the third decade counter 30 reaches the output pin j, the signal is supplied to the reset pin 60 of the first decade counter 26, resetting the first counter and preparing the digital circuit to restart the sequence of controlled illumination of the first, second and third sets of lights in the manner just described.

In this manner, the first and second sets of lights of the display panel 10 are illuminated in sequence beginning with the LEDs L1 and L2 and terminating with the LEDs L27 and L28. Following the sequential illumination of the lights of the first and second sets, the lights of the third set L31–L40 are simultaneously illuminated twice by the digital circuit. The digital circuit is then reset to repeatedly perform the sequential illumination of the lights discussed above.

Although a particular digital circuit has been disclosed employing specific semi-conductor chips in a specific circuit arrangement, it will be understood that the disclosed circuit is exemplary only, and that other circuit arrangements may be employed to produce the same operation of the three sets of lights of the display panel of the present invention without departing from the scope of the invention.

While the present invention has been described by reference to a specific embodiment, it should be understood that modifications and variations of the invention may be constructed without departing from the scope of the invention defined in the following claims.

What is claimed is:

1. An illuminating display comprising:

a display panel mounting a plurality of lights;

a first set of lights of the plurality being spatially arranged around a left side of the panel perimeter;

a second set of lights of the plurality being spatially arranged around a right side of the panel perimeter;

the first and second sets of lights each having an equal number of lights;

a third set of lights of the plurality being arranged in the shape of an arrow between the first and second set of lights; and control means for controlling sequential illumination of lights of the first and second set of lights where each light of the first set is paired with a light of the second set and the control means controls sequential, simultaneous illumination of pairs of lights of the first and second sets, and for controlling illumination of the third set of lights following the illumination of the first and second sets of lights.

2. The illuminating display of claim 1 comprising:

the control means controlling the illumination of the lights of each of the first and second sets one light at a time.

3. The illuminating display of claim 2 comprising:

the control means controlling the sequential illumination of the lights of the first and second sets, starting with lights of the first and second sets at the middle of the bottom of the panel and continuing with the lights of the first and second sets arranged around the left and right sides of the panel, respectively, to the lights of the first and second sets at the middle of the top of the panel.

4. The illuminating display of claim 2 comprising:

the control means controlling the simultaneous illumination of the lights of the third set following the sequential illumination of the lights of the first and second sets.

5. The illuminating device of claim 3 comprising:

the control means controlling the simultaneous illumination of the lights of the third set following the sequential illumination of the lights of the first and second sets in sequence.

6. The illuminating display of claim 1 comprising:

the third set of lights being arranged in an upper, middle area of the panel and the first, second and third sets of lights surrounding a center area of the panel.

7. The illuminating display of claim 6 comprising:

a placard means secured to the center area of the panel.

8. The illuminating display of claim 7 comprising:

fastener means on the center area of the panel, the fastener means releasably securing the placard means to the panel.

9. An illuminating display comprising:

a vertical display panel mounting a plurality of lights;

a first set of lights of the plurality being spatially arranged around a left side of the panel perimeter;

a second set of lights of the plurality being spatially arranged around a right side of the panel perimeter;

the first and second sets of lights each having an equal number of lights;

a third set of lights of the plurality being arranged in the shape of an arrow between the first and second sets of lights; and control means for controlling illumination of the lights of each of the first and second sets where each light of the first set is paired with a light of the second set and the control means controls sequential, simultaneous illumination of pairs of lights of the first and second sets from a bottom middle area of the panel around the opposite left and right sides of the panel to a top middle area of the panel, and for controlling simultaneous illumination of the lights of the third set following the sequential illumination of the lights of the first and second sets.

10. The illuminating display of claim 9 comprising:

the first, second and third sets of lights, all being arranged around the periphery of the panel and surrounding a center area of the panel, and placard means secured on the center area of the panel.

11. The illuminating display of claim 10 comprising:

releasable fastener means on the center area of the panel, the fastener means being adapted to releasably secure the placard means on the panel.

12. The illuminating display of claim 9 comprising:

the display panel having a rectangular configuration with the first set of lights being arranged adjacent to the peripheral edge of the left half of the panel and the second set of lights being arranged adjacent to the peripheral edge of the right half of the panel.

13. The illuminating display of claim 9 comprising:

the first set of lights including fourteen lights, the second set of lights including fourteen lights, and the third set of lights including ten lights.

14. The illuminating display of claim 10 comprising:

the third set of lights being mounted in the middle of the panel above the center area.

15. An illuminating display comprising:

a vertical display panel having a rectangular configuration with top and bottom edges and right and left side edges;

a first set of lights spatially arranged on a front surface of the panel from a middle area of the bottom edge of the panel, along the bottom edge to the left side edge of the panel, up the left side edge to the top edge of the panel, and along the top edge to a middle area of the top edge of the panel;

a second set of lights spatially arranged on the front surface of the panel from the middle area of the bottom edge of the panel, along the bottom edge to the right side edge of the panel, up the right side edge to the top edge of the panel, and along the top edge to the middle area of the top edge of the panel;

the first and second sets of lights each having an equal number of lights;

a third set of lights arranged in the shape of an arrow on the front surface of the panel in a middle area of the panel; and control means for controlling sequential illumination of the lights of the first and second sets, where each light of the first set is paired with a light of the second set and the control means controls sequential, simultaneous illumination of pairs of lights of the first and second sets beginning with the lights at the bottom middle area of the panel and sequencing around the left and right side edges of the panel and across the top edge of the panel to the top middle area of the panel, and the for controlling illumination of the third set of lights simultaneously.

* * * * *